United States Patent [19]

Schrank et al.

[11] Patent Number: 4,834,631

[45] Date of Patent: May 30, 1989

[54] SEPARATOR AND BIASING PLATE

[75] Inventors: Douglas A. Schrank; Thomas W. Carter, both of Baldwinsville; Joseph P. Vaccaro, Chittenango; William R. Lane, Dewitt, all of N.Y.

[73] Assignee: Carrier Corporation, Syracuse, N.Y.

[21] Appl. No.: 177,277

[22] Filed: Apr. 4, 1988

[51] Int. Cl.[4] ..... F04B 49/10

[52] U.S. Cl. ..... 417/283; 417/571

[58] Field of Search ..... 417/562, 283, 296, 307, 417/571, 564, 457

[56] References Cited

U.S. PATENT DOCUMENTS

| | | | |
|---|---|---|---|
| 1,831,411 | 11/1931 | Dietz | 417/DIG. 1 |
| 1,901,478 | 3/1933 | Sutton et al. | 417/558 |
| 3,358,908 | 12/1967 | Gawin | 417/571 |
| 4,336,004 | 6/1982 | Grabb | 417/283 |
| 4,401,416 | 8/1983 | Tuckey | 417/283 |
| 4,408,963 | 10/1983 | Drutchas | 417/283 |

*Primary Examiner*—Carlton R. Croyle
*Assistant Examiner*—Robert N. Blackmon
*Attorney, Agent, or Firm*—David J. Zobkiw

[57] ABSTRACT

In a reciprocating compressor, the separator plate separating the suction and discharge plenums acts as a spring relative to the valve plate assembly. Under liquid slugging conditions the valve plate moves against the biasing force of the separator plate to establish a relief passage between the piston cylinder and the suction plenum.

10 Claims, 2 Drawing Sheets

SEPARATOR AND BIASING PLATE

BACKGROUND OF THE INVENTION

Reciprocating refrigerant compressors, designed exclusively for refrigerant vapor duty, are over stressed during liquid slugging conditions where liquid refrigerant and/or oil are present in the piston cylinder. When handling large volumes of liquid refrigerant and/or oil, cylinder pressures can approach and exceed 3000 psi rather than 400 psi as would be the case for R-22 in normal operation where no liquid is present. This high pressure is due to the overall restriction of valve ports, lines etc. as well as the head and the fact that the discharge valves are cycling at, for example, 3450 cycles per second and cannot handle the greater mass of material that is present during liquid slugging without greatly increasing the chance of damaging the suction valves. To withstand pressures this high would require strengthening of several components and there could be a reduction in long term reliability. The resultant unit would also be more massive and expensive to manufacture. Also, the relatively fragile suction valves are subject to permanent deformation at these elevated pressures.

SUMMARY OF THE INVENTION

The separator plate of a compressor which serves to separate the suction and discharge plenums and to hold the valve plate in place also acts as a biasing means relative to the valve plate. Discharge pressure acts on the separator plate and tends to keep the valve plate in place so that by optimizing the separator plate thickness and modifying the cylinder head and valve plate, the separator plate can act as a biasing means for the valve plate and thereby define a relief mechanism as cylinder pressures approach 1500 psi, for example.

It is an object of this invention to reduce cylinder pressures under liquid slugging conditions.

It is a further object of this invention to provide a separator plate which seals under normal conditions and acts as a biasing means relative to the valve plate under liquid slugging conditions. These objects and others, as will become apparent hereinafter, are accomplished by the present invention.

Basically, the separator plate separating the suction and discharge plenums holds the valve plate in place in a sealing arrangement assisted by the differential pressure between the plenums in normal operation and the suction and discharge valves operate in a normal fashion. If slugging conditions exist, the direction of the pressure differential reverses. The separator plate then provides a resilient bias to the valve plate which unseats to permit a portion of the oil and/or liquid refrigerant to leak back to the suction side and thereby bypass the discharge system made up of ports, valves, heads, lines, etc. and reduce the maximum pressure reached.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
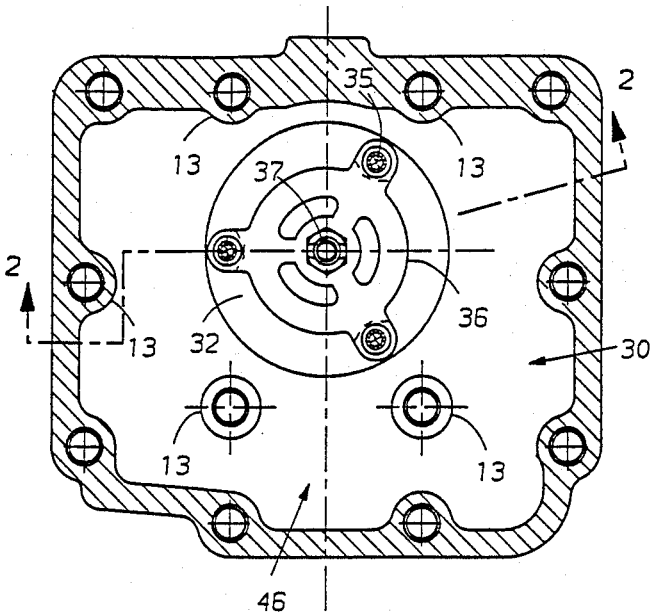
FIG. 1 is a top view of a valve plate assembly.
Figure 2:
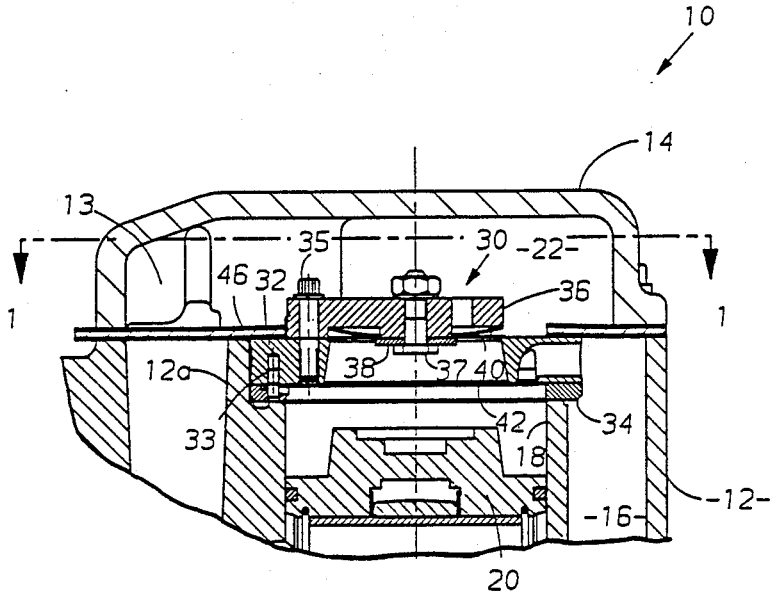
FIG. 2 is a partial sectional view of a cylinder block and head assembly employing the separator and biasing plate of the present invention and taken along a line corresponding to line 2—2 of FIG. 1.

In FIG. 2, the numeral 10 generally designates a compressor having a cylinder block 12 and a cylinder head 14. Cylinder block 12 defines annular suction plenum 16 and piston cylinder 18. Piston 20 reciprocates in piston cylinder 18. Cylinder head 14 defines discharge plenum 22. Valve plate assembly 30 includes valve plate 32 which is doweled to suction valve guide 34 by dowel pins 33 (only one of which is illustrated). Discharge valve guide 36 is attached to valve plate 32 by screws 35. Inner seat 38 is bolted to discharge valve guide 36 by bolt 37 and provides the inner seat and support for discharge valve 40. Suction valve 42 is located between valve plate 32 and suction valve guide 34 and is guided by dowel pins 33. The valve plate assembly 30 is received in cylinder block 12 so as to overlie piston cylinder 18. Valve plate assembly 30 is prevented from radial movement by a plurality of circumferentially spaced projections 12*a* of cylinder block 12 as best shown in FIG. 2. Valve plate 30 is overlain and normally held in place in cylinder block 12 by annular separator plate 46 which is peripherally held between spaced projections 12*a* of the cylinder block 12 and cylinder head 14 by bolts (not illustrated) or any other suitable means. The structure, except for projections 12*a*, described so far is conventional and during the suction stroke of piston 20 discharge valve 40 will be held seated on valve plate 30 and refrigerant would be drawn by vapor pressure from suction plenum 16 past the unseated suction valve 42 into the piston cylinder 18. On the discharge stroke of piston 20 suction valve 42 will be held seated by vapor pressure and discharge valve 40 will unseat to permit the compressed refrigerant to pass from piston cylinder 18 to discharge plenum 22. The operation just described is conventional and if oil and/or liquid refrigerant were present in the cylinder 18 in sufficient amounts, the resultant liquid slugging could damage compressor 10. Specifically, the piston 20 may be cycling at 3450 cycles per second so that the increased mass in the cylinder cannot be forced out rapidly enough and the pressure rises due to the incompressibility of the liquids. Discharge valve 40 is forced fully open against discharge valve guide 36 and generally would not be damaged, but suction valve 42 can be permanently deformed by extruding into the suction inlets 43.

Figure 3:
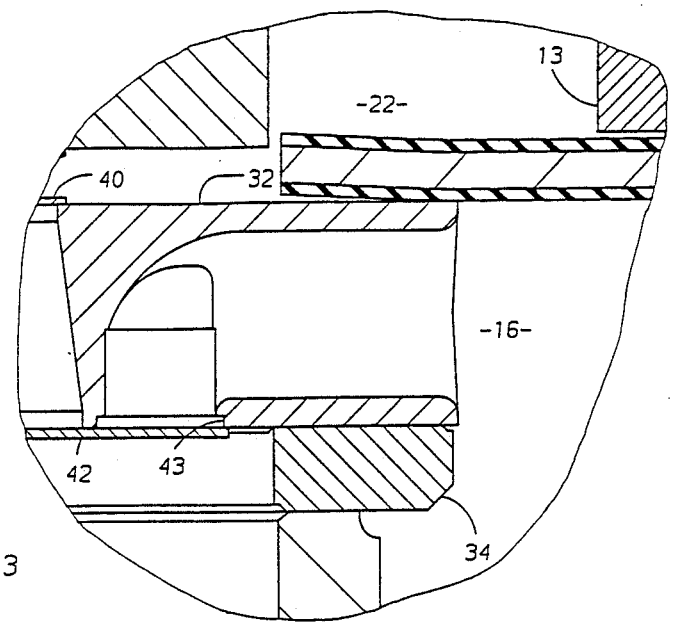
FIG. 3 is an enlarged sectional view of a portion of the cylinder block and head assembly of FIG. 2.
Figure 4:
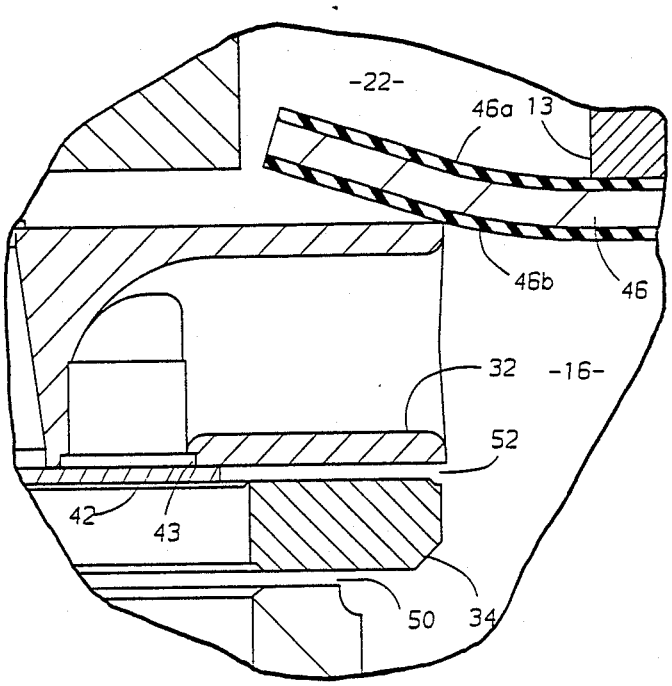
FIG. 4 is an enlarged sectional view corresponding to FIG. 3 but with the valve plate unseated.

According to the present invention, cylinder head 14 is preferably provided with a plurality of spaced projections 13 which are located in the discharge plenum 22 but spaced from separator plate 46 by a small distance of, nominally, 0.150 inches, or less, under normal circumstances. Separator plate 46 has its thickness optimized for deflection such that there is minimal deflection and leakage under normal conditions at a low pressure differential across separator plate 46, e.g. less than 450 psi, and significant deflection, e.g. 0.010 inches, at the location of projections 13 which serve as a stop under liquid slugging conditions at high pressure differential, e.g. 1500 psi. As best shown in FIGS. 3 and 4, separator plate 46 has a gasket material 46*a* and *b* coating each side. Separator plate 46 is at an angle to valve plate 32 so that there is a line contact between separator plate 46 and valve plate 32 although the angle and spacing between the members is very small. The gasket material 46*a* and *b* provides a better seal between separator plate 46 and valve plate 32 as well as between cylinder block 12 and cylinder head 14. The deflection of separator plate 46 is caused by fluid pressure under slugging conditions in the piston cylinder 18 acting on valve plate assembly 30 in a reversed pressure differential opposed only by the biasing force of separator plate 46. As a result, valve plate assembly 30 can move off of cylinder block 12 a small distance, e.g. 0.010 inches as shown in FIG. 4. Dowel pins 33 may cause suction valve guide 34 to move as a unit with the rest of the valve assembly 30, or, as illustrated, may permit their separation. In any event, under liquid slugging conditions an annular space 50 will be established between suction valve guide 34 and cylinder block 12 and/or an annular space 52 will be established between suction valve guide 34 and valve plate 32. Annular spaces 50 and 52 provide direct fluid communication between the piston cylinder 18 and suction plenum 16.

From the foregoing, it should be clear that valve plate 30 acts as a valve which is normally held biased closed by separator plate 46 which acts as a flattened Belleville spring. Projections 13 act as valve stops for valve plate 32 and separator plate 46. Where the diametrical cylinder head bolt spacing was 3.30 inches and the cylinder bore diameter was 2.25 inches, a 0.062 inch stainless steel separator plate was formed to hold cylinder pressure to about 1500 psi under liquid slugging conditions.

Although a preferred embodiment of the present invention has been illustrated and described, other changes will occur to those skilled in the art. It is therefore intended that the scope of the present invention is to be limited only by the scope of the appended claims.

What is claimed is:

1. A compressor means comprising:

valve plate assembly means including a valve plate and suction and discharge valves;

cylinder block means defining a piston cylinder and a suction plenum and receiving said valve plate assembly means so as to normally permit flow into and out of said piston cylinder only through said suction and discharge valves;

separator plate means having an inner and an outer portion;

cylinder head means defining a discharge plenum and having a surface coacting with said cylinder block means to pivotably secure said separator plate means at said outer portion whereby said inner portion biasingly engages said valve plate assembly means and coacts therewith to separate said suction and discharge plenums and to normally bias said valve plate assembly means into engagement with said cylinder block means;

whereby when said valve plate assembly means is subjected to liquid slugging conditions said valve plate assembly means moves against the bias of said separator plate means causing the pivoting thereof and a relief flow path is established past said valve plate assembly means.

2. The compressor means of claim 1 further including stop means carried by said cylinder head means and normally spaced from said separator plate means.

3. The compressor means of claim 1 wherein said relief flow path extends between said piston cylinder and said suction plenum.

4. The compressor means of claim 2 wherein said stop means is radially inward of said outer portion whereby the point of pivoting of said separator plate changes upon engagement with said stop means.

5. The compressor means of claim 4 wherein said stop means is made up of a plurality of projections.

6. A compressor means comprising:

valve plate assembly means including a valve plate and suction and discharge valves and having first and second sides;

cylinder block means defining a piston cylinder and a suction plenum and receiving said valve plate assembly means so that said first side of said valve plate assembly means defines one end of said piston cylinder;

separator plate means having first and second sides and an inner and an outer portion;

cylinder head means defining a discharge plenum and having a surface engaging said first side of said outer portion of said separator plate and coacting with said cylinder block means to pivotably secure said separator plate means at said outer portion such that said second side of said inner portion of said separator plate biasingly engages said second side of said valve plate assembly means to normally bias said valve plate assembly means in place on said cylinder block means;

said separator plate means and said valve plate means coacting to separate said suction and discharge plenums whereby said first side first side of said separator plate means and the second side of said valve plate assembly means are normally subjected to discharged pressure, said second side of said separator plate means is normally subjected to suction pressure and said first side of said valve plate assembly means is normally subjected to piston cylinder pressure which ranges between suction pressure and discharge pressure;

whereby when said first side of said valve plate assembly means is subjected to liquid slugging conditions said valve plate assembly means moves against the bias of said separator plate means causing the pivoting thereof and a relief flow path is established past said valve plate assembly means.

7. The compressor means of claim 6 further including stop means carried by said cylinder head means and normally spaced from said first side of said separator plate means.

8. The compressor means of claim 6 wherein said relief flow path extends between said piston cylinder and said suction plenum.

9. The compressor means of claim 7 wherein said stop means is radially inward of said outer portion whereby the point of pivoting of said separator plate changes upon engagement with said stop means.

10. The compressor means of claim 7 wherein said stop means is made up of a plurality of projections.

* * * * *